US005342021A

United States Patent [19]

Watson

[11] Patent Number: 5,342,021

[45] Date of Patent: Aug. 30, 1994

[54] DECORATIVE FORM FOR CHAIN LINK FENCES

[76] Inventor: David Watson, 5987 Wiltshire St., Vancouver, B.C. V6M 3L8, Canada

[21] Appl. No.: 108,444

[22] Filed: Aug. 19, 1993

[51] Int. Cl.[5] ..... E04H 17/00

[52] U.S. Cl. ..... 256/1; 256/32; 40/622

[58] Field of Search ..... 256/1, 45, 32; 40/489, 40/584, 611, 620, 622

[56] References Cited

U.S. PATENT DOCUMENTS

| | | | |
|---|---|---|---|
| 1,575,409 | 3/1926 | Blaeser | 256/32 |
| 3,774,884 | 11/1973 | Singer . | |
| 3,964,197 | 6/1976 | Tucker | 40/622 |
| 4,542,051 | 9/1985 | Cirimele | 40/489 |
| 4,651,975 | 3/1987 | Howell . | |
| 5,177,890 | 1/1993 | Hisatomi | 256/32 |

*Primary Examiner*—Randolph A. Reese

*Assistant Examiner*—Anthony Knight

*Attorney, Agent, or Firm*—Burke-Robertson

[57] ABSTRACT

A decorative form for a chain link fence of the type having post-supported interwoven wires producing a matrix of wire lengths extending between wire cross-over centers. The form is to be used with other similar forms to produce a decorative pattern over an area of the chain link fence. The form comprises a pair of sections each having a face with circumscribing sides and interlocking means to secure the sections together along edges of their sides. The sections, when secured together over a cross-over center produce a hollow form having opposed faces and sides extending therebetween. The sides of the form have slots, when the form is so seated, located as to be seated over corresponding portions of the wire lengths extending outwardly from that center. A plurality of such forms, when secured to a chain link fence at predetermined locations may produce a predetermined design.

11 Claims, 2 Drawing Sheets

DECORATIVE FORM FOR CHAIN LINK FENCES

BACKGROUND OF THE INVENTION

The present invention relates to a decorative form for chain link fences, and more particularly relates to a plurality of such forms which may be secured to a chain link fence as a system of graphic elements to produce a decorative design.

Chain link fences, of the type having post-supported interwoven wires producing a matrix of wire lengths extending between wire cross-over centers, are frequently used for fencing in areas for commercial, institutional (e.g. schoolyards), domestic, agricultural and other purposes. Such fences are not terribly attractive and have conventionally been "decorated" simply by painting the wire or wires a particular colour. The wires are normally spaced sufficiently far apart that lettering or designs painted on the fence would be unrecognizable. Hence the fences, when painted are normally in a single colour.

In U.S. Pat. No. 3,774,884 of Singer issued Nov. 27, 1973, a square plaque is taught which has deformable tabs at its periphery. These tabs are intended to be wrapped around the wires of a chain link fence so the plaque or plaques cover one or more of the mesh openings between the wires. U.S. Pat. No. 4,651,975 of Howell issued Mar. 24, 1987 describes and illustrates a system of grooved blocks of square configuration, with light wire connectors, the blocks to be installed onto the wires of the fence by way of the grooves and secured there by means of the wire connectors, thereby to close the openings in the mesh and provide privacy or wind protection.

It is an object of the present invention to provide an alternative construction of decorative form for a chain link fence which is economical to construct and simple to install. It is a further object of one embodiment of the present invention to provide such a device which will be difficult to tamper with, once installed on a chain link fence.

SUMMARY OF THE INVENTION

In accordance with the present invention, there is provided for such a chain link fence a decorative form, to be used with other similar forms to produce a decorative pattern over an area of the chain link fence. The form comprises a pair of sections each having a face with circumscribing sides and interlocking means to secure the sections together along edges of their sides. The sections, when secured together over a cross-over center, produce a form having a hollow interior and having opposed faces with sides extending therebetween. The sides of the form have slots, when the form is so seated, located so as to be seated over corresponding portions of the wire lengths extending outwardly from that center.

The form in accordance with the present invention is economical to construct and simple to install. Where, as in a preferred embodiment of the invention, the interlocking means are constructed and positioned so as to be within the hollow interior of the form, are difficult to tamper with.

BRIEF DESCRIPTION OF THE DRAWINGS

These and other objects and advantages of the invention will become apparent upon reading the following detailed description and upon referring to the drawings in which.

Figure 1:
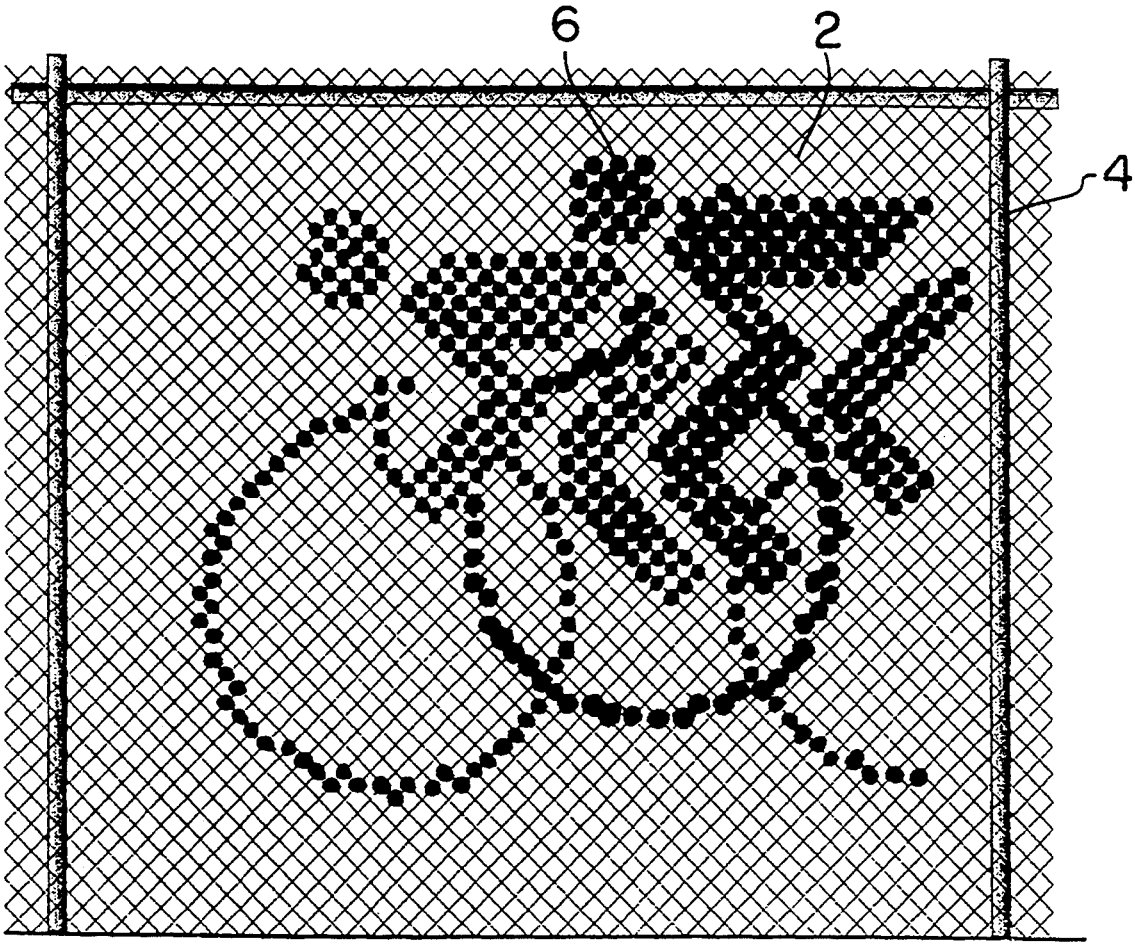
FIG. 1 is a plan view of a section of chain link fence on which a plurality of forms, in accordance with the present invention, having been installed to provide a graphic design.

While the invention will be described in conjunction with an illustrated embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings, similar features have been given similar reference numerals.

Turning to the drawings there is illustrated in FIG. 1, on a conventional chain link fence 2, supported by posts 4, a design created by a plurality of forms 6 in accordance with the present invention.

Figure 2:
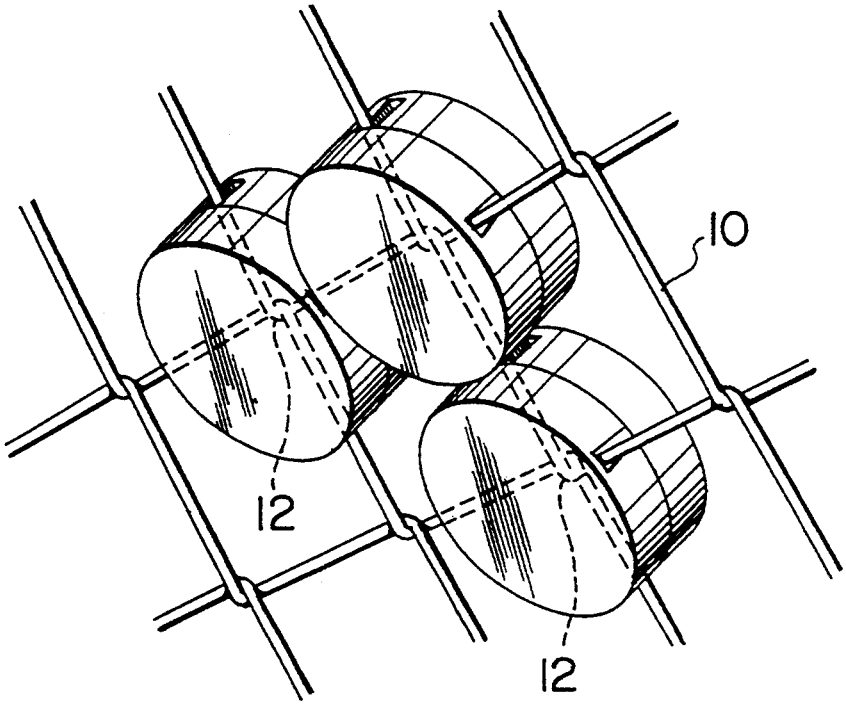
FIG. 2 is an enlarged view in perspective of a portion of the fence of FIG. 1, illustrating in more detail the location and positioning of the forms of the present invention thereon.
Figure 3:
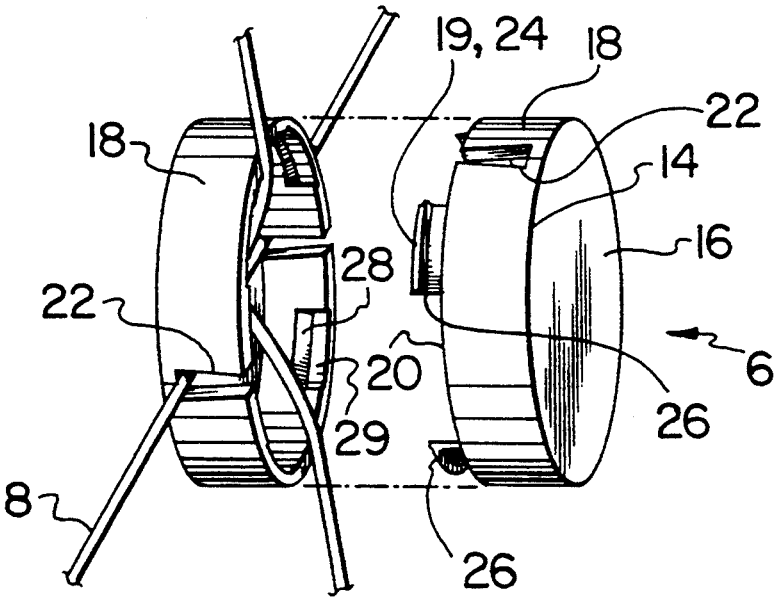
FIG. 3 is an exploded perspective view of a pair of sections which produce a form in accordance with the present invention on a chain link fence.

As can be seen more particularly in FIGS. 2 and 3, chain link fence 2 is formed by wires 8 which have been interwoven, as illustrated, to produce a matrix of wire lengths 10 extending between wire cross-over centers 12. It should be noted, particularly from FIG. 3, that each wire 8 "enters" and "departs" from each cross-over point 12 in a different plane, so that, in a sense, the chain link fence, when viewed in plan from above, has a thickness being the distance between the two planes in which the lengths 10 of each wire 8 sit.

In accordance with the present invention, a plurality of forms 6 are secured at appropriate cross-over points 12. Each of the forms 6 comprises a pair of sections 14, in the illustrated embodiment of circular or disc-like configuration, having a face 16 and circumscribing sides 18. The sections 14 are each provided with appropriate interlocking means 19 so that they can be secured together along confronting edges 20 of sides 18 to produce a form 6 having a solid exterior appearance. When the sections 14 are secured together, each opposing face 16 is seated on an opposite side of fence 2, and the hollow interior of the form 6, thus produced, encloses a corresponding cross-over point 12 of wires 8 and portions of lengths 10.

Slots 22 are provided, at 180° opposed locations, in sides 18 of each section 14 as illustrated, through which corresponding lengths 10 of wire 8 may pass when the sections are in position on and over a cross-over point 12 on fence 2. The slots 22 of each section are, however, offset 90° with respect to the slots of the corresponding section 14 when in position, as will be understood from FIG. 3, since the lengths 10 on each "side" of fence 2, at a particular cross-over point 12 are similarly offset 90° with respect to the corresponding lengths 10, on the same wire 8, on the "other" side of the fence at that cross-over point. The depths of slots 22 are preferably such as to minimize lateral movement of the forms when the sections are secured together in position over a cross-over point on the fence.

As well, it will be understood from FIG. 3 that the distance between the inner surfaces of faces 16, when sections 14 are secured together on a cross-over point 16, must be at least as great as the "thickness" of the fence so that wires 8 will not obstruct the securing together of sections 14 at that location.

The interlocking means 19 are preferably formed so as to be hidden from view, when sections 14 are secured together, minimizing the ability of a person to tamper with the form when in position. In the illustrated embodiment, interlocking means 19 comprises a plurality of lugs 24 extending downwardly from an inner surface of sides 18, of one of the sections 14, outwardly extending catches 26 being positioned at the extremities of lugs 24 as illustrated. At corresponding, appropriate locations in the other of the sections 14 are provided corresponding grooves 28 for catches 26. To facilitate the securing together of sections 14, guide channels 29 are provided in the walls of section 14 adjacent grooves 28, to facilitate the passage of the corresponding catch 26, on the other section 14, to groove 28. Lugs 24 are provided with some resiliency, and the outer surfaces of catches 26 are bevelled so that catches 26 will ride over the edges of the other section 14 and inner surfaces of sides 18 until they contact grooves 28, into which they will then spring in mated engagement. While this construction of interlocking means is a preferred one, because of its ability to minimize tampering, it will be understood that any other form of interlocking means, permanent or releasable, may be provided to the sections 14, appropriate to any given function or location in which the forms 6 may be used.

The sections 14 may be of any appropriate material, but are preferably of molded, rugged plastic. They may also be of any desired colour or colours, appropriate to a desired graphic design for fence 2.

When in position, as illustrated in FIG. 1, a plurality of plugs provide an attractive, highly visible graphic design for a fence which may significantly improve that fences appearance. While a design has been illustrated in FIG. 1, it is obvious that, alternatively, a plurality of forms 6 may be assembled on a fence 2 to provide written text, for example as a tool for corporate identification or to provide a relatively permanent, strongly visible indication of hazards which might exist behind a fence. Once in position, the sections provided with the interlocking means as described herein are extremely difficult to remove, minimizing the chance for vandalism or other forms of unwanted removal. Moreover, the forms in accordance with the present invention, when compared with previously noted prior art chain line fence attachments, are extremely simple to construct and install.

Thus it is apparent that there has been provided in accordance with the invention a decorative form for a chain link fence that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A decorative form for a chain link fence of the type having post-supported interwoven wires producing a matrix of wire lengths extending between wire cross-over centers, the form to be used with other similar forms to produce a decorative pattern over an area of the chain link fence, the form comprising a pair of sections, each having a face with circumscribing sides and interlocking means to secure the sections together along edges of their sides, the sections, when secured together over a cross-over center, producing a form with a hollow interior and having opposed faces with sides extending therebetween, the sides of the form having slots, when the form is so seated, located as to be seated over corresponding portions of the wire lengths extending outwardly from that center.

2. A form according to claim 1 wherein the interlocking means are constructed and positioned so as to be within the hollow interior of the form to minimize tampering when the sections are secured together.

3. A form according to claim 2 wherein the securing means comprise a plurality of lugs, each lug extending from an interior surface of one of the sections, each lug having an extremity with a catch thereon, and a corresponding, catch receiving groove located on an inner surface of the other of the sections, for each lug.

4. A form according to claim 1 wherein the sections are of similar shape and are provided with circular faces and edges to produce, when secured together, a form having a cylindrical appearance.

5. A form according to claim 3 wherein the sections are of similar shape and are provided with circular faces and edges to produce, when secured together, a form having a cylindrical appearance.

6. A form according to claim 1 wherein the sides of each section are provided with a pair of slots positioned 180° from each other, the slots in one section being 90° offset from the slots in the other section when the sections are in position secured together.

7. A form according to claim 5 wherein the sides of each section are provided with a pair of slots positioned 180° from each other, the slots in one section being 90° offset from the slots in the other section when the sections are in position secured together.

8. A system of graphic elements for a chain link fence comprising a plurality of forms according to claim 1 to be secured to a chain link fence at predetermined locations to produce a predetermined design.

9. A system according to claim 8 wherein the forms have circular faces.

10. A system according to claim 8 wherein the forms are of a plurality of colours.

11. A form according to claim 1 wherein the slots are of a depth such as to minimize lateral movement of the forms when the sections are secured together in position over a cross-over point on the fence.

* * * * *